US006318480B1

(12) United States Patent
Hearn

(10) Patent No.: US 6,318,480 B1
(45) Date of Patent: Nov. 20, 2001

(54) DRILLING OF LATERALS FROM A WELLBORE

(75) Inventor: David D. Hearn, Anchorage, AK (US)

(73) Assignee: Atlantic Richfield Company, Los Angeles, CA (US)

( * ) Notice: Subject to any disclaimer, the term of this patent is extended or adjusted under 35 U.S.C. 154(b) by 0 days.

(21) Appl. No.: 09/461,306

(22) Filed: Dec. 15, 1999

(51) Int. Cl.[7] ..... E21R 7/08
(52) U.S. Cl. ..... 175/61; 175/73
(58) Field of Search ..... 175/61, 75, 76, 175/73, 320

(56) References Cited

U.S. PATENT DOCUMENTS

| | | | | |
|---|---|---|---|---|
| 2,397,070 | | 3/1946 | Zublin . | |
| 3,349,845 | | 10/1967 | Holbert et al. . | |
| 3,398,804 | | 8/1968 | Holbert . | |
| 4,523,652 | | 6/1985 | Schuh . | |
| 4,629,012 | * | 12/1986 | Schuh | 175/75 |
| 4,653,598 | * | 3/1987 | Schuh et al. | 175/75 |
| 5,195,591 | | 3/1993 | Blount et al. . | |
| 5,222,554 | | 6/1993 | Blount et al. . | |
| 5,346,017 | | 9/1994 | Blount et al. . | |
| 5,363,929 | * | 11/1994 | Williams et al. | 175/107 |
| 5,383,522 | | 1/1995 | Hailey . | |
| 5,423,389 | * | 6/1995 | Warren et al. | 175/75 |
| 5,826,651 | * | 10/1998 | Lee et al. | 166/117.6 |
| 5,857,531 | * | 1/1999 | Estep et al. | 175/75 |

OTHER PUBLICATIONS

"Short–Radius Horizontal Drilling System Optimization in Yates Field Unit"; W. J. Tank; SPE Drilling & Completion, Mar., 1997 pp. 43–47.

* cited by examiner

*Primary Examiner*—Frank Tsay
(74) *Attorney, Agent, or Firm*—Drude Faulconer

(57) ABSTRACT

A method and apparatus for drilling a lateral from a primary wellbore having a short radius-of-curvature. The lateral is drilled by a downhole drilling unit which differs from prior art units of this type in that instead of connecting the drill bit directly to the downhole motor, a length of flexible drill pipe is used to connect the bit to the rotary power output of the motor. This length of flexible drill pipe below the downhole motor allows much larger build-up angles (e.g. 1–3° per foot) which, in turn, reduces the time and expense for short-radius laterals and increase the accuracy of placement of the lateral within the zone of interest (e.g. production formation).

9 Claims, 3 Drawing Sheets

DRILLING OF LATERALS FROM A WELLBORE

DESCRIPTION

1. Technical Field

The present invention relates to downhole assembly for drilling laterals or the like from a primary wellbore and in one aspect relates to a method and apparatus for drilling laterals such as drain holes and/or entries for short-radius horizontal wells which are to extend outward from a primary wellbore.

2. Background

In producing hydrocarbons from subterranean formations, it is not uncommon to drill a primary wellbore downward from the surface through the formations and then drill one or more horizontal wellbore(s) (sometimes called "laterals") outward from the primary wellbore into the producing formation(s). This is an effective and economical way to increase the drainage of formation fluids into the primary wellbore thereby increasing the overall recovery of fluids through a single, primary well. These laterals may extend outwardly from the primary wellbore for substantial distances (e.g. 1300 feet or more) or they may be relatively short "drainholes" which extend only a few feet (e.g. 100 feet or less) into the formation.

Several techniques are known for drilling laterals from primary wellbores. For example, some of the first laterals were drilled using standard rotary drilling techniques wherein the lower end of the drill string included an articulated or flexible section (i.e. "wigglies") positioned just above the bit which, when diverted by a whipstock in the wellbore, drilled a lateral having a pre-determined radius of curvature; see U.S. Pat. Nos. 2,397,070; 3,349,845; and 3,398,804.

While this technique works well for drilling relatively large-radius laterals, it requires a rotary drilling rig and crew to drill each lateral. This is both expensive and time consuming. Also, due to the actual construction of the flexible drill pipe section, the "build-up" angle of the lateral must be accurately predicted in order to insure that the lateral will end up within the zone of interest (e.g. production formation). Still further, due to the inherent flexibility of the articulated section of the drill pipe, directional control is difficult to maintain during drilling of the lateral.

With the advent of "coiled-tubing" and downhole mud motors, rotary drilling rigs are no longer required for the drilling of laterals from a wellbore. As will be understood in the art, "coiled tubing" is a long, continuous length of a relatively small-diameter, thin-walled steel tubing which is wound onto and off a large-diameter reel. Being of a continuous length, no joints of pipe have to be made-up or broken-out as the tubing is run into and out of the wellbore thereby saving substantial time, expense, and manpower. Also, since a downhole motor is used to drive the bit, the coiled tubing does not have to be rotated.

In drilling laterals with coiled tubing, a downhole mud motor having a drill bit at its lower end is connected onto the lower end of the coiled tubing string. As the coiled tubing is lowered into the primary wellbore, the bit is deflected by a whipstock in the wellbore towards the direction in which the lateral is to be drilled. A drilling fluid, e.g. mud, is pumped down the coiled tubing and through the downhole motor to rotate the bit to thereby drill the lateral away from the wellbore.

The inherent flexibility of the coiled tubing permits drilling with relatively large build-up angles (i.e. short radius of curvature) which is an important consideration since not only is drilling time for each lateral reduced but also the accuracy in positioning a particular lateral within its desired zone is increased. That is, a lateral can be "kicked-off" within the wellbore at a point much closer to its destination point within a desired zone since the transition from the relatively vertical wellbore to the relatively horizontal lateral will be much shorter.

However, the maximum build-up angle which may achieved with known coiled tubing techniques is limited, at least in part, by the length of the housing of the downhole motor, itself. The motor, which is at the leading edge of the coiled tubing, must enter and advance through the lateral as the lateral is being drilled away from the primary wellbore. That is, since the motor housing is inflexible, the radius of curvature of the lateral, as it is drilled and reamed from the relative vertical wellbore to its relative horizontal portion within the zone of interest, must be large enough to allow the motor to readily pass therethrough without binding.

Accordingly, it can be seen that there is always a need for new ways to further increase the build-up angle (i.e. shorten the radius of curvature) when drilling laterals from a primary wellbore. The shorter the radius, the quicker and less expensive the laterals can be drilled and the more accurately they can be placed within the zones of interests, i.e. production formation(s).

SUMMARY OF THE INVENTION

The present invention provides a method and apparatus for drilling a lateral, e.g. a drainhole, from a primary wellbore wherein large build-up angles (i.e. short radius-of-curvatures) are possible. Basically, a lateral is drilled by a downhole drilling unit which differs from prior art units of this type in that instead of connecting the drill bit directly to the downhole motor, a length of flexible drill pipe is used to connect the bit to the rotary power output of the motor. This length of flexible drill pipe below the downhole motor allows much larger build-up angles (e.g. 1–3° per foot) which, in turn, reduces the time and expense for short-radius laterals and increase the accuracy of placement of the lateral within the zone of interest (e.g. production formation).

More specifically, the present invention provides a method and apparatus for drilling laterals from a primary wellbore wherein a downhole drilling unit is lowered into the primary wellbore on a workstring, e.g. coiled tubing. The downhole workstring is comprised of a conventional rotary mud motor which has a rotary power output and which is powered by a power fluid, e.g. drilling mud, flowing down the workstring. A length of flexible drill pipe, e.g. carbon-fiber composite pipe, is connected at its one end to the power output of said motor whereby operation of said motor will rotate the flexible drill pipe and the build-up assembly which is connected to the other end of the flexible drill pipe. The build-up assembly is comprised a knuckle-joint, a reamer, and a bit. connected to said reamer.

As the downhole drilling assembly is lowered into the primary wellbore by the coiled tubing, the bit of the build-up assembly contacts and is deflected off a whipstock which has been positioned within the primary wellbore at a point substantially adjacent the formation into which the lateral is to be drilled. Mud is pumped down the coiled tubing to operate the motor which, in turn, rotates the bit at the end of the flexible drill string. The flexibility of the drill string allows the bit to readily drill the transitional portion of the lateral in a relatively short, tight arc with a relatively small radius of curvature when compared to laterals drilled in prior art.

BRIEF DESCRIPTION OF THE DRAWINGS

The actual construction, operation, and apparent advantages of the present invention will be better understood by referring to the drawings which are not necessarily to scale and in which like numerals identify like parts and in which.

BEST KNOWN MODE FOR CARRYING OUT THE INVENTION

Figure 1:
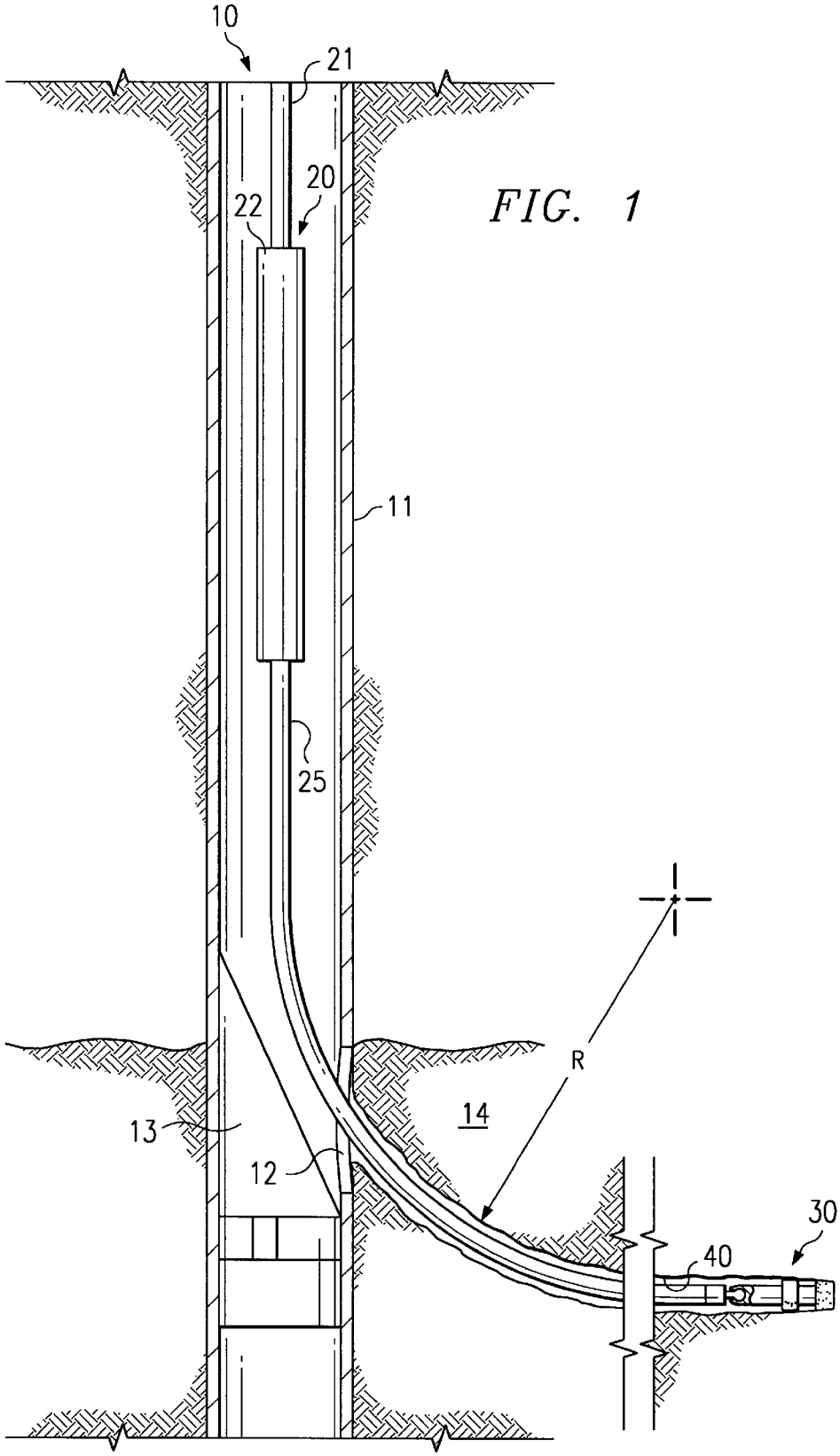
FIG. 1 is a sectional view of a section of a wellbore from which a lateral is being drilled in accordance with the present invention.

Referring more particularly to the drawings, FIG. 1 illustrates a section of a primary wellbore 10 which has been cased with casing 11 as will be understood in the art. Casing 11 has a window 12 therein which can be formed with any well known window-forming technique. A whipstock 13 is set in the casing 11 at a point substantially adjacent a zone (i.e. producing formation 14) into which a lateral or horizontal wellbore is to be drilled. Any of several whipstocks can be used, e.g. see U.S. Pat. Nos. 5,346,017, 5383,522, both of which are incorporated herein by reference.

"Horizontal wellbore" or "lateral", as used herein, is used as a relative term and is intended to refer to any wellbore which curves outwardly from a primary wellbore. Typically, the primary wellbore 10 is drilled substantially vertically from the surface downward to or through the producing formation but, as will be fully recognized by those skilled in the art, the primary wellbore 10 may also be slanted or inclined with respect to the vertical or in some instances, may even be horizontal, itself. In the latter case, the "horizontal wellbores" would then be wellbores which would extend upward or downward or to the sides of the primary wellbore.

In accordance with the present invention, a downhole drilling unit 20 is assembled and connected to the lower end of coiled tubing string 21. As will be understood in the art, "coiled tubing", as used herein, is a continuous length of a relatively small diameter (e.g. 2 to 3 inches). thin-walled metal tubing (e.g. steel or other high-strength, alloy tubing such as titanium alloy) which can be wound onto and off of a reel (not shown) at the surface. Tubing 21 is fed into and out of by an injector unit (not shown) which is positioned above the wellhead at the surface. Coiled tubing rigs of this type are well known and are commercially-available from various suppliers (e.g. Hydra-Rig, Fort Worth, Tex.).

Downhole drilling unit 20 is comprised of a downhole drilling motor 22 which is of the type which is driven by flowing a power fluid (e.g. drilling mud) therethrough. That is, motor 22 may be a conventional, rotary mud motor having a rotary power output (not shown). Such motors are universally known and are commercially-available from several suppliers (e.g. Baker INTEQ, Weatherford, Sperry Sun, etc.). Normally a drill bit is connected to the rotary power output of motor 22 but in accordance with the present invention, a length (e.g. from about 15 to about 35 feet) of a relative flexible, hollow drill pipe 25 is connected thereto whereby the drill pipe 25 is rotated by motor 22.

Figure 4:
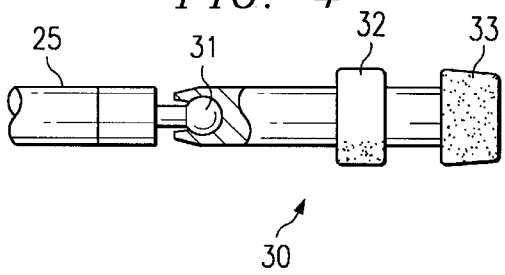
FIG. 4 is a "build-up assembly" connected to the lower end of a drill pipe.

Drill pipe 25 may be constructed of any material which has the necessary strength and enough fatigue resistance to withstand the drilling operation and at the same time provide the flexibility needed; e.g. carbon-fiber composite pipe, supplied by Lincoln, Composites, Lincoln, Nebr. Other materials such as small diameter, high strength steel can also be used. Connected to the lower end of drill pipe 25 is "build assembly" 30 (FIG. 4) which, in turn, is comprised of knuckle joint 31, reamer 32, and drill bit 33.

As will be understood, in build assemblies of this type, bit 33 drills the initial bore or path for lateral 40 while reamer 32 enlarges the hole concentrically and acts as a fulcrum for the assembly. Knuckle joint 31 buckles to the outside of the curved lateral 40 (FIG. 1) under axial compressive load thereby moving the ball and socket of the knuckle joint 31 off the centerline of the lateral by the amount of radial clearance. This off-set and the relative spacing of the bit 33, reamer 32, and knuckle joint 31 provide three points that define the curved path of the lateral. For a further discussion of such assemblies, see U.S. Pat. Nos. 3,398,804 and 3,349,845 both of which are incorporated herein by reference.

In operation, whipstock 13 is set in primary wellbore 10 at a point substantially adjacent formation 14 into which lateral 40 is to be drilled. Downhole drilling unit 20 is lowered on coiled tubing 21 until bit 33 of build-up assembly 30 contacts whipstock 13. Power fluid, e.g. drilling mud, is pumped down coiled tubing 21 and through motor 22 to drive the motor which, in turn, rotates flexible drill string 25 to rotate build-up assembly 30. It should be recognized that window 12 may have already been cut in casing 11 by any well known window-cutting operation or it may be formed by bit 33, itself, as it is deflected off whipstock 13. Further, in some primary wellbores, the zone of interest may be uncased. Mud will flow through motor 22, flexible drill pipe 25, build-up assembly 30 and out bit 33 to carry cuttings back to the surface as will be understood in the art.

Figure 2:
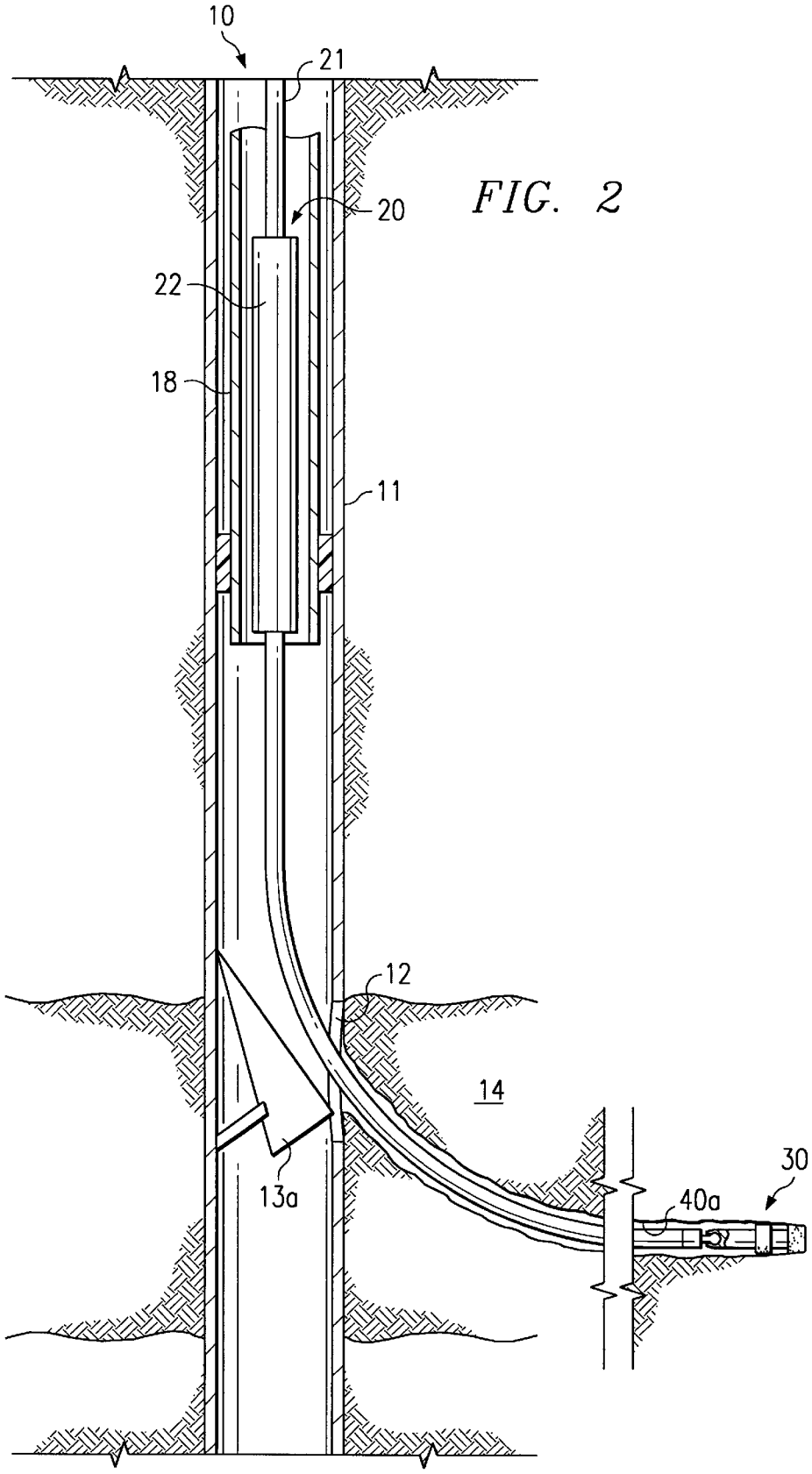
FIG. 2 is a sectional view of a section of a wellbore having a string of production tubing therein through which a lateral is being drilled in accordance with the present invention.
Figure 3:
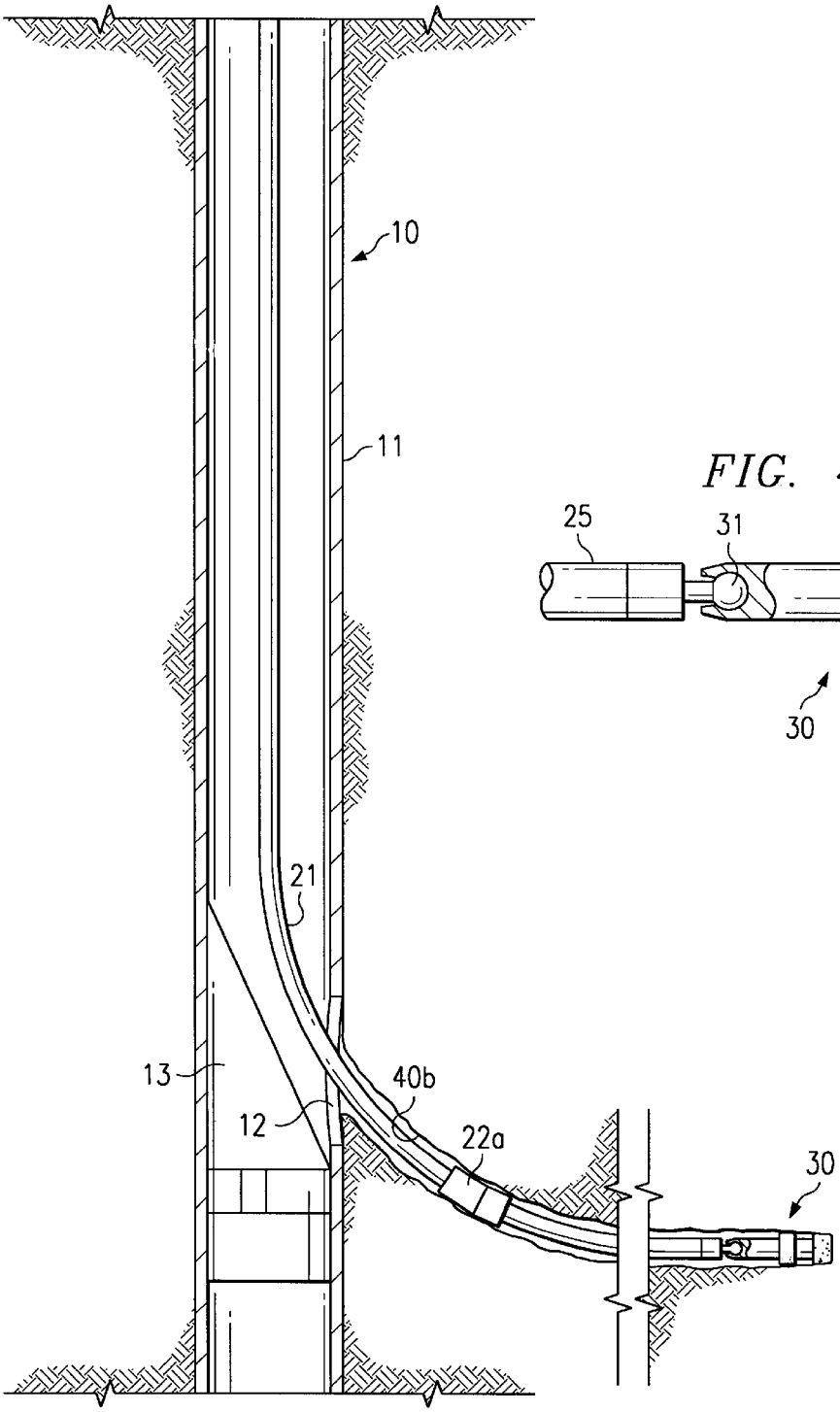
FIG. 3 is a sectional view of a section of a wellbore from which a lateral is being drilled in accordance with a further embodiment of the present invention.

In FIG. 2, the present invention is shown being carried out through the production tubing 18 in primary wellbore 10. Everything else is basically identical to that described above except a "through-tubing" whipstock 13a (see U.S. Pat. 5,222,554) is used to deflect the flexible drill string into formation 14. In the embodiments of FIGS. 1 and 2, motor 22 never needs to enter the lateral 40 as it is being drilled and can remain in primary wellbore 10. This allows motors having relatively long housings to be used in the drilling of short-radius laterals 40, 40*a*. The embodiment of the present invention shown in FIG. 3 is also similar to that of FIG. 1 except a specially-constructed downhole motor 22*a* is used instead of conventional motor 22 in the downhole drilling unit. The housing of motor 22*a* is comprised of short lengths which, in turn, are pivotably connected to provide an articulated housing whereby the motor can follow the build-up assembly 30 and flexible drill pipe 25 into lateral 40b as it is being drilled.

To summarize, the present invention provides a way to quickly and economically drill several short-radius "drainholes" or the like into a producing formation(s) from a single primary wellbore. Further, it allows conventional mud motors to be used in drilling these short-radius (see "R" in FIG. 1) which have large build-up angles (e.g. 1–3° per foot). This, in turn, provides greater accuracy in properly positioning the lateral into the desired zone of interest since long transition intervals are not required.

What is claimed is:

1. A downhole drilling unit for drilling a lateral from a primary wellbore, said unit comprising:

a downhole motor adapted to be connected onto the lower end of a workstring to be lowered thereby into said primary wellbore, said motor having a rotary power output;

a length of flexible drill pipe connected at one end to said power output of said motor whereby operation of said motor will rotate said flexible drill pipe; and a build-up assembly connected to the other end of said flexible drill pipe for drilling said lateral upon rotation of said flexible drill pipe by said motor; said build-up assembly comprising:

a knuckle-joint connected to said other end of said flexible drill pipe; and a bit connected to said knuckle-joint.

2. The downhole drilling unit of claim 1 wherein said workstring is comprised of coiled tubing.

3. The downhole drilling unit of claim 1 wherein said downhole motor comprises:

a conventional rotary mud motor operated by a power fluid.

4. The downhole drilling unit of claim 1 wherein said flexible drill pipe is comprised of carbon-fiber composite pipe.

5. The downhole drilling unit of claim 1 wherein said flexible drill pipe is comprised of steel pipe.

6. The downhole drilling unit of claimed 1 including:

a reamer connected between said knuckle-joint and said bit.

7. A method for drilling a lateral into a subterranean formation from a primary wellbore, said method comprising:

positioning a whipstock in said primary wellbore substantially adjacent said formation;

lowering a downhole drilling assembly on a workstring into engagement with said whipstock, said downhole drilling assembly comprising a rotary motor having a rotary power output, a flexible drill string connected at one end to the output of said motor and at its other end to a build-up assembly including a bit;

operating said motor as said workstring is lowered in said primary wellbore to rotate said flexible drill string and said bit as said bit is deflected off of said whipstock and into said formation; and continuing to operate said motor until the drilling of said lateral is complete.

8. The method of claim 7 wherein said workstring is comprised of coiled tubing.

9. The method of claim 8 wherein said motor is a conventional rotary mud motor and said step of operating said motor comprises:

flowing a power fluid down said coiled tubing and through said mud motor.

* * * * *